US005626710A

United States Patent [19]

Moll

[11] Patent Number: 5,626,710

[45] Date of Patent: May 6, 1997

[54] FOLD PLATE FOR INLINE FOLDER/GLUER MACHINES

[76] Inventor: Richard J. Moll, 415 Constance Dr., Warminster, Pa. 18974

[21] Appl. No.: 461,148

[22] Filed: Jun. 5, 1995

[51] Int. Cl.[6] ..... B31F 1/00

[52] U.S. Cl. ..... 156/477.1; 156/227; 156/444; 493/399; 493/453

[58] Field of Search ..... 156/204, 227, 156/444, 477.1; 493/245, 251, 264, 399, 441, 453

[56] References Cited

U.S. PATENT DOCUMENTS 4,816,108 3/1989 Beck et al. ..... 156/477.1

4,865,578 9/1989 Moll ..... 493/331

5,439,436 8/1995 Moll ..... 493/245

*Primary Examiner*—George Yeung

*Attorney, Agent, or Firm*—Zachary T. Wobensmith, III

[57] ABSTRACT

A fold plate for use with in line folder/gluer machines and particularly folding machines that fold a blank having a multiplicity of layers of material, which machine includes a vertically adjustable stop and one roller on its bottom which contacts the layers of folded material as they are advanced thereunder by a conveyor belt and drive wheels from the folding machine.

7 Claims, 5 Drawing Sheets

FOLD PLATE FOR INLINE FOLDER/GLUER MACHINES

BACKGROUND OF THE INVENTION

Field of the Invention

This invention relates to a fold plate for use with inline folder/gluer machines where the fold plate includes at least one roller on its bottom to contact and assist the card stock being folded.

DESCRIPTION OF THE PRIOR ART

In the printLing trade paper folding machines use fold plates in conjunction with other apparatus to fold flaps on paper stock about prescored lines. With inline folder/gluer box folding machines for example, a prescored blank has side flaps that are folded upwardly, and contiguous glue flaps that are folded downwardly along the score lines and about former bars by guide plates. Glue is applied to the glue flaps, and a pair of end flaps are engaged by a tipper plate or with air pressure blast which urges them upwardly into engagement with a stop on a vertical fold plate. The tipper plate moves to a horizontal position and a drive plate engages the blank to urge it under the fold plate, which causes the end flaps to fold down onto the glue flaps forming a pocket fold. The fold plates used in such apparatus typically have a rounded bottom portion which contacts the end flaps to fold them down about a prescored line onto the glue flaps. The blanks are travelling at high speed, and the fold plate often leaves undesirable marks on the stock being folded at the point of impact with the fold plate, which is particularly noticeable on many types of coated paper stock.

In my prior patent application Ser. No. 08/245,439 filed May 18, 1994, now U.S. Pat. No. 5,439,436, a fold plate is described for use in Boxed Pocket Folders. However the fold plate of the present invention is useful with many different in line folder/gluer machines.

The fold plate of the invention does not suffer from the short comings of the prior art apparatus, and provides many positive advantages.

SUMMARY OF THE INVENTION

This invention relates to a fold plate for use in an inline folder/gluer machine for paper wherein a prescored blank with at least one end panel is carried on a conveyor belt which urges the panel against a fold plate where it moves upwardly until it engages stops. The blank is urged under the fold plate by the conveyor belt, which fold plate has at least one roller to engage the end panel and urge it downwardly about the score line and against the blank.

The principal object of the invention is to provide a fold plate for use in inline folder/gluer machines that have a roller on the bottom thereof to contact portions of a card stock blank to be folded.

A further object of the invention is to provide a fold plate of the character aforesaid, which is fast and accurate in its operation, and provides a high quality finished product.

A further object of the invention is to provide a fold plate of the character aforesaid, which can operate with a variety of types of card stock.

A further object of the invention is to provide a fold plate of the character aforesaid, which can operate with a variety of inline folder/gluer machines.

A further object of the invention is to provide a fold plate of the character aforesaid, which offers less friction resistance to the card stock being folded than prior art fold plates.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
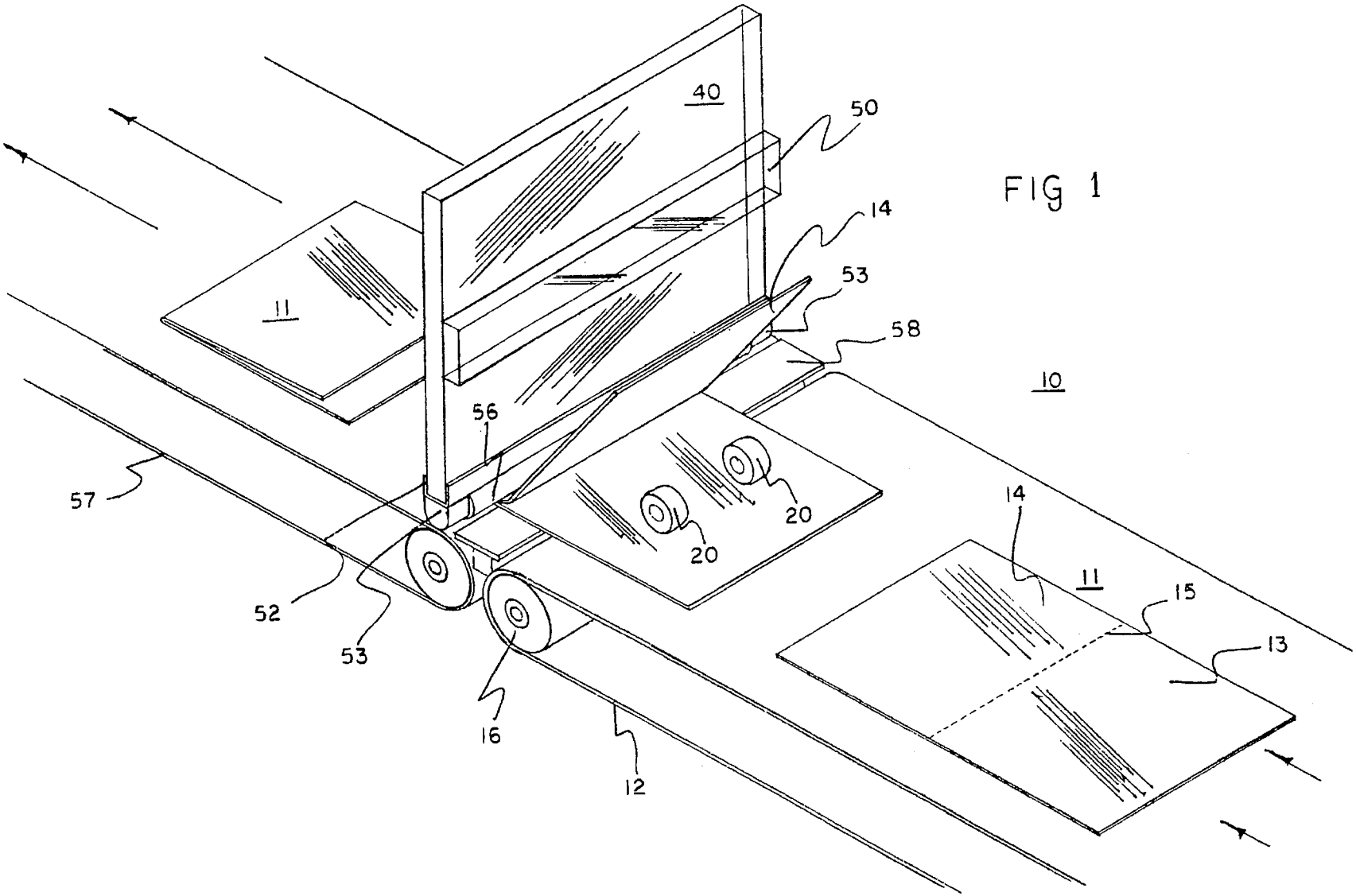
FIG. 1. is a perspective view of a portion of a typical folding machine illustrating the operation of the fold plate of the invention.

It should, of course, be understood that the description and drawings herein are merely illustrative and that various modifications and changes can be made in the structure disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to the drawings and FIGS. 1–6, a folding machine 10 which folds a blank 11 is therein illustrated. The folding machine 10 as illustrated is typical of the inline folder/gluer machine types that fold prescored blanks of card stock.

The folding machine 10 comprises several sections, i.e., a gluing section, a forming section, and a delivery section.

The machine 10 includes an endless conveyor belt 12 which receives the blanks 11 from a feeder apparatus (not shown). The blanks 11 include a main panel 13 which is connected to end panel 14 along score line 15. The conveyor belt 12 is driven by two rollers 16 which are driven by a belt (not shown) in well known manner. As shown sequentially in FIG. 1 and proceeding from right to left, the blanks 11 proceed in the gluing section and may pass under glue dispensing heads (not shown) of conventional and well known type, such as described in my prior U.S. Pat. No. 4,865,578. The glue heads (not shown) are connected to a source of glue (not shown) by a hose (not shown), and dispense a measured amount of glue onto blank 11 as required.

The blanks 11 are now in the forming section.

A vertically oriented fold plate 40 is provided above belt 12 which may be mounted to a bracket (not shown) in well known manner.

A pair of top drive wheels 20 are illustrated which rest on top of blanks 13 to assist in driving them into fold plate 40 in well known manner.

The plate 40 has an adjustable stop plate 50 mounted thereto by bolts (not shown) engaged in vertical slots (not shown).

The plate 40 has a roller assembly 51 on the bottom thereof. The roller assembly 51 includes a U-shaped channel 52, which may be adhesively fastened to the fold plate 40 by adhesive of well known type, or by screws (not shown). The channel 52 has two bearing blocks 53 fastened thereto by bolts 54 of well known type. The blocks 53 are engaged with a roller 56 which can rotate in the blocks 53.

The roller 56 is preferably formed of stainless steel.

Figure 2:
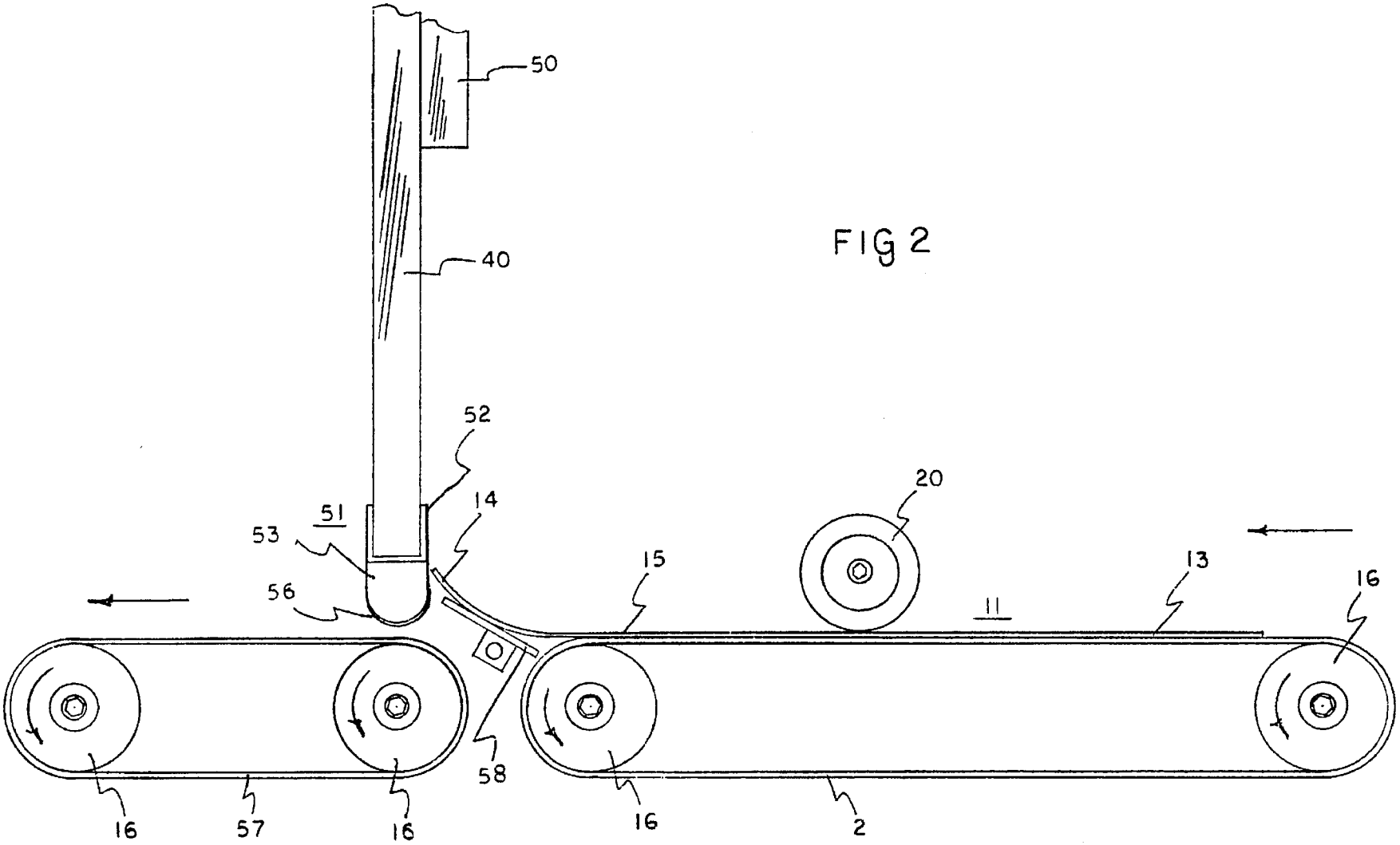
FIG. 2. is a side elevational fragmentary view, enlarged illustrating the fold plate in operation with a deflector plate paper deflector.
Figure 4:
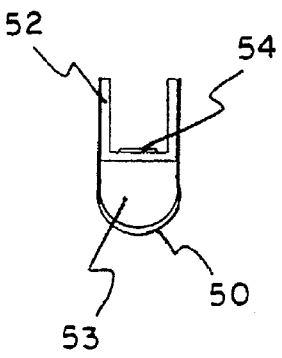
FIG. 4 is an end elevational view of the assembly of FIG. 3.
Figure 3:
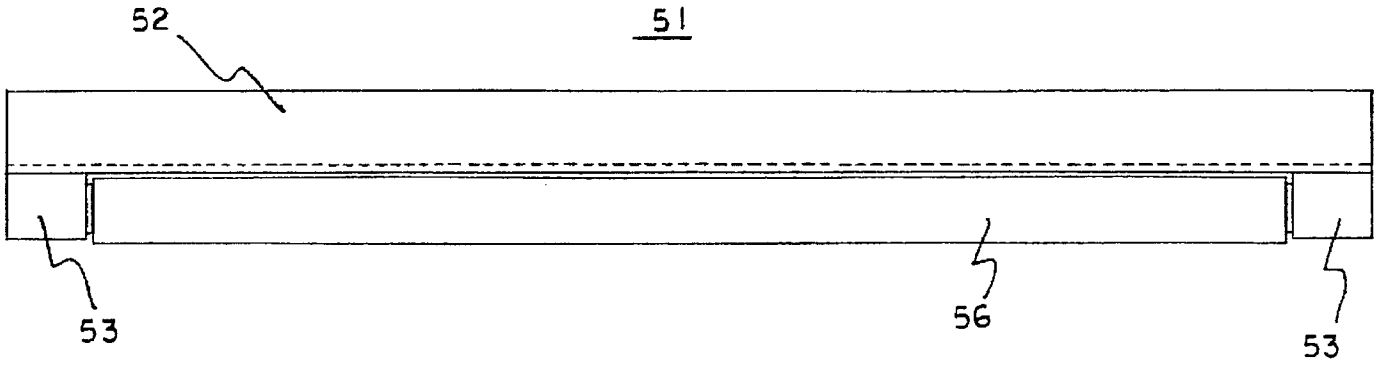
FIG. 3. is a front elevational view illustrating the fold plate roller assembly.
Figure 5:
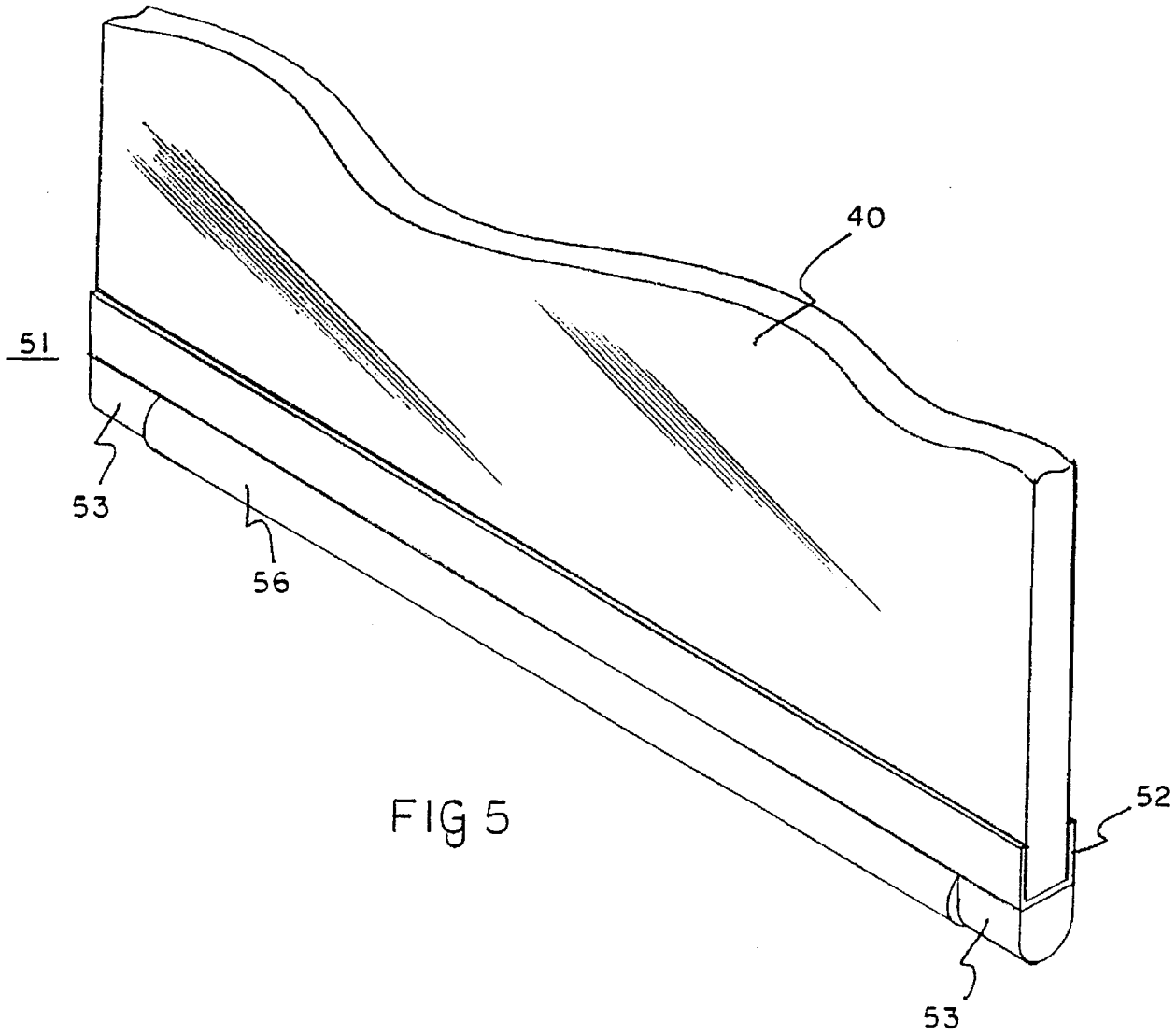
FIG. 5 is a fragmentary perspective view of the fold plate roller assembly in place on a fold plate.
Figure 6:
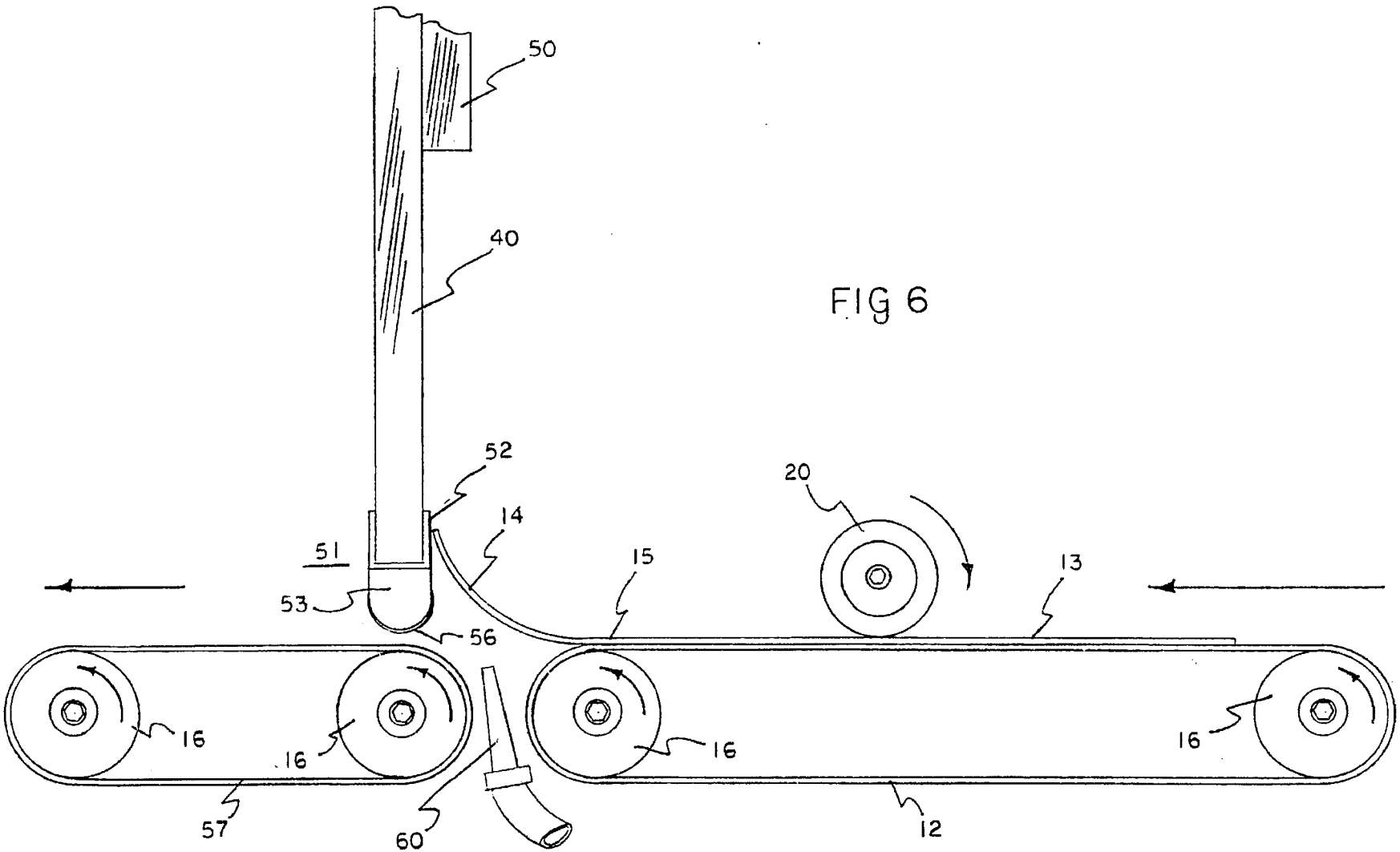
FIG. 6 is a view similar to FIG. 2 illustrating the apparatus with the optional air blast jet paper deflector.

The belt 12 carries blanks 11 to fold plate 40 where the end panel 13 is forced upwardly against fold plate 40 by a tiltable deflector plate 58 and the drive wheels 20, as shown in FIG. 2, to a vertical position against stop plate 50. If desired, as shown in FIG. 6., an intermittent air blast jet 60 may be provided instead of deflector plate 58.

The completed folders 11 from the forming section are deposited onto a conveyor belt 57 in the delivery section, which transports them to a storage area (not shown) for packaging and shipment to the users.

The mode of operation will now be pointed out. A blank 11 iS deposited on belt 12 of folding machine 10. Belt 12 carries blanks 11 past glue heads (not shown), which deposit glue thereon.

The blanks 11 on belt 12 are carried to fold plate 40 where the end panel 13 is forced upwardly by deflector plate 58, or air blast jet 60 to and against stop plate 50.

Blank 11 continues to move to the left under fold plate 40 by action of belt 12 and driving wheels 20. As the blank 11 travels to and under plate 40 the roller 56 engages the end panel 13 which moves down along plate 40, is folded down about score line 15 until it meets main panel 13, and is carried on belt 57 to and through the delivery section. The operation is repeated with other blanks 11 as described.

It will thus be seen that apparatus has been provided with which the objects of the invention are achieved.

I claim:

1. In an apparatus with an inline folder/gluer machine for forming a folded product from a prescored card stock blank, which blank has at least one score line which divides it into a plurality of panels, which include at least a main panel and an end panel, which machine includes: a gluing section, a forming section and a delivery section, said forming section includes an endless conveyor belt to receive and transport blanks to be folded, deflector means to cause a portion of said blank to be deflected upwardly, top drive wheel means to contact said blank, said gluing section having glue dispensing means to dispense measured amounts of glue onto said blank, and said delivery section having conveyor belt means to receive finished folded products, and transport them for packaging and shipping, the improvement which comprises fold plate means to cooperate with said conveyor belt and said deflector means to cause said end panels to be folded down onto said main panels, said fold plate means including a vertically adjustable fold plate mounted to bracket means carried on said machine, vertically adjustable stop plate means carried on said plate, and roller assembly means carried on the bottom of said fold plate means to contact said end panel of said blank and cause it to fold down about said score line onto said main panel as said blank is urged by said conveyor belt under said fold plate.

2. Apparatus as defined in claim 1 in which said roller assembly means includes U-shaped channel means secured to said fold plate bearing blocks secured to said channel and a roller rotatably carried in said bearing blocks.

3. Apparatus as defined in claim 2 in which said roller is of stainless steel.

4. Apparatus as defined in claim 2 in which said channel means is adhesively secured to said fold plate.

5. Apparatus as defined in claim 2 in which said channel means is secured to said fold plate by screws.

6. Apparatus as defined in claim 1 in which said deflector means is a movable deflector plate.

7. Apparatus as defined in claim 1 in which said deflector means is an intermittent air blast jet.

* * * * *